United States Patent [19]

Goddard et al.

[11] 4,089,716

[45] May 16, 1978

[54] IGNITION ENHANCING PROPELLANT COATINGS

[75] Inventors: Terrence P. Goddard, Aptos; Donald N. Thatcher, Hollister; Charles G. Garrison, San Jose, all of Calif.

[73] Assignee: Teledyne McCormick-Selph, an operating division of Teledyne Industries, Inc., Hollister, Calif.

[21] Appl. No.: 795,477

[22] Filed: May 10, 1977

[51] Int. Cl.[2] ..... C06B 45/28

[52] U.S. Cl. ..... 149/10; 149/9; 149/11; 149/22

[58] Field of Search ..... 149/22, 9, 10, 11; 260/564 D

[56] References Cited

U.S. PATENT DOCUMENTS 4,002,681 1/1977 Goddard ..... 260/564 D

*Primary Examiner*—Stephen J. Lechert, Jr.

*Attorney, Agent, or Firm*—David H. Semmes; Warren E. Olsen

[57] ABSTRACT

This invention teaches preparation of individual and uncoated propellant grains by incorporating a coating or integral layer of ignition compound, specifically simple salts of decahydrodecaboric acid and coprecipitates of these salts with an oxidizer. The resulting propellant grains so prepared exhibit substantially improved ignition capability, virtually independent of ambient conditioning temperature conditions at the time of use.

23 Claims, No Drawings

IGNITION ENHANCING PROPELLANT COATINGS

CROSS-REFERENCES TO RELATED APPLICATIONS

This application incorporates by reference a copending application of common assignment entitled CO-PRECIPITATED PYROTECHNIC COMPOSITION PROCESSES AND RESULTANT PRODUCTS, Ser. No. 694,626, filed June 10, 1976, which is a continuation-in-part of the application entitled HIGH BURN PROPELLANT COMPOSITIONS, Ser. No. 585,216, filed June 6, 1975, now abandoned.

This application is also a related case to another copending application of common assignment entitled ACTIVE BINDER PROPELLANTS INCORPORATING BURNING RATE CATALYSTS, Ser. No. 696,324, filed June 15, 1976, which related to uniform nitrocellulose-containing propellant compositions, employing the same decahydrodecaborate (−2) compounds which are employed herein. In distinction, the present invention is categorically concerned with treating of individual grains of existing types of nitrocellulose-based propellant, and creating a product which is usuable directly in place of the untreated forms of such granular propellants, for example in gun applications.

Our copending application entitled CONSOLIDATED CHARGES INCORPORATING INTEGRAL IGNITION COMPOUNDS, filed May 10, 1977, and assigned Ser. No. 795,473, employs the same ignition compounds employed herein as a matrix between consolidated grain-to-grain boundaries while the present invention teaches a new ignition structure for each grain, without reliance upon a matrix between individual grains.

BACKGROUND AND BRIEF DESCRIPTION OF INVENTION

The purpose of this invention is to describe propellant grains which demonstrate significantly better ignition characteristics than state-of-the-art propellant grains.

In the design of devices incorporating a propellant, and particularly those devices that use the burning propellant gases to accomplish mechanical work, such as gun ammunition, a controlled amount of gas and heat must be released within a specified time period by the burning propellant.

With existing propellants, for example those based on nitrocellulose, nitrocellulose/nitroglycerine, and nitrocellulose/nitroglycerine/nitroguanidine, and bettern known to those practices in the art as "single base", "double base", and "triple base" propellants, respectively, the burning rate of the propellant is fixed within rather narrow limits by the formulation; a major change in propellant formulation is required to significantly alter such characteristics as burning rate. As a result, to control the release of heat and gas in a device such as a rocket motor chamber, gun chamber, or other gas generating device, the propellant is configured into a sometimes complicated three dimensional geometry, known as a "grain", so that the amount of surface burning at a given time is controlled. The inherent burning rate of the propellant and the grain size and geometry determine the burning rate or "quickness" of the propellant mass. In many instances, a substance is used in the outer layer of the grain to retard the initial burning rate, and is known as a "deterrent layer." Additionally, most propellant grains designed for use in guns incorporate an outer layer of graphite glazed onto the propellant surface; needed to protect the grain and reduce the handling hazards due to friction and static electricity.

The function sequence of the propellant burning can be discussed in terms of two events: (1) ignition of the exterior surface of the grain, and (2) regressive burning of the propellant grain. The first event, ignition, depends on the propagation of a flame front, generated by a priming source and burning of the propellant ignited first, through the propellant bed or along a monolithic grain. In a loosely packed bed of individual propellant grains, this gaseous flame front propagates easily through the interstitial voids in the bed. However, due to the deterrents and coatings on the grain, and in some cases, the nature of the propellant itself, the actual ignition of the propellant matrix by the hot gas is retarded, particularly at low temperature. It is additionally believed by those practiced in the art that a certain amount of hot particles, i.e., condensed chemical species in the flame, contribute substantially to the ignition event, in addition to the hot gases; the propagation of such hot particles through a propellant bed is difficult compared to the gas propagation.

This invention describes propellant grains otherwise similar to state-of-the-art propellant grains, but fabricated to incorporate an ignition compound or burning rate enhancing layer as a coating or as a chemically bound surface layer on each propellant grain, and thus dispersed uniformly along each monolithic grain that comprises a propellant bed. The burning rate enhancer, specifically consisting of selected compounds based on certain decahydrodecaborate (−2) salts, greatly facilitates propagation of the initiating flame front along the propellant surface, and/or through the propellant bed. The propellants described by this invention demonstrate significantly better ignition and burning characteristics than similar state-of-the-art propellant grains at ambient temperature; the improvement is even more marked at low temperature.

DETAILED DESCRIPTION OF THE INVENTION

The present invention describes a method, and resultant product, of manufacturing or treating propellant grains to incorporate a coating of an integral ignition composition, specifically ignition compounds that are themselves, or contain, certain salts of decahydrodecaboric acid.

The manufacture of coated propellants according to the present invention consists, firstly, of obtaining a suitable propellant in grain or spherical configuration with a range of burning properties and chemical composition which will give the desired rate of gas evolution and composition of combustion products for the intended purpose, such as accelerating a projectile in a gun. Commonly used propellants for this purpose are "single", "double", or "triple base" propellants (as they are commonly known by those practiced in the art), and these propellants may incorporate one or more layers on the grain surface, such as various types of polymers (known as a "deterrent" layer), to aid in modifying initial ignition characteristics. The propellant may be configured in spherical or ellipsoidal shapes, representative diameters or average diameters of 0.01 inch to 0.05 inch or more and known as "ball propellant," or cylindrical shapes with one or more longitudinal perforations, with characteristic web dimensions 0.009 inches to 0.03 inches or more.

For the purpose of this invention, it is critical that the starting propellant grains do not have a graphite layer on the grain surface, as a graphite layer, if desired, must be applied during or after the subject ignition enhancer is added to the grain. The method and principle of incorporating the ignition compound into the propellant grain is general to any of the types of commonly used individual grain nitrocellulose base propellants, and the classes listed and examples presented are not intended to be limiting, except as noted.

According to the present invention, the decahydrodecaborate compound is conveniently applied to existing propellant grains by means of a solvent or fluid carrier. The decahydrodecaborate compound, depending on the class as delineated below, may be soluble or insoluble in this solvent or carrier. The geometry and thickness of the ignition enhancing layer is determined by the solvating power of the solvent or vehicle on the propellant, and the solubility of the decahydrodecaborate compound in the fluid. For example, a solvent such as acetone, with high solvating power on a typical propellant, would carry a dissolved decahydrodecaborate compound deeply into the propellant matrix, resulting in a new propellant composition with a gradient of decahydrodecaborate compound in a typical cross section across the propellant web. In contrast, a solvent with low solvating ability, such as isopropanol, used as a carrier for an insoluble decahydrodecaborate compound would, when applied to a typical propellant, result in essentially a surface layer of adhering and highly concentrated decahydrodecaborate ignition enhancer. The methods and types of solvents and decahydrodecaborate compounds described in this invention encompass a range of coating or layering options between the extremes.

The ignition compounds useful in this invention are from two general classes; the first, Class (1), being simple salts of decahydrodecaboric acid, and the second, Class (2), being coprecipitates of salts from Class (1) with a suitable oxidizing agent.

The two classes of decahydrodecaborate compounds are defined as follows:

Class (1)

The simple decahydrodecaborate salts used in this invention are compounds of the general chemical formula:

$$M_x(B_{10}H_{10})_y$$

where M is a cation or complex cation incorporating hydrogen, nitrogen, carbon, or metals, or some combination thereof, and is chosen from the list given below; $x$ is the number of M ions; and $y$ is equal to:

$$\frac{x \text{ times the valence of the } M \text{ ion}}{2}$$

The compounds may further be defined as certain salts of decahydrodecaboric acid, and thus contain as a common ion the decahydrodecaborate (−2) anion $B_{10}H_{10}^{-2}$.

The cation M is chosen from the classes:

a. ammonium, $NH_4+$, wherein the salt has the formula $(NH_4)_2B_{10}H_{10}$, and is described by KNOTH U.S. Pat. No. 3,148,938.

b. hydrazinium, $NH_2NH_3+$, wherein the salt has the formula $(NH_2NH_3)_2B_{10}H_{10}$, and is described by KNOTH U.S. Pat. No. 3,148,938.

c. substituted ammonium cations, wherein the salt has the general formula $(R_3NH)_2B_{10}H_{10}$, where R can be hydrogen (H) or alkyl radical (preferred radicals contain less than six carbon atoms). The R's in the preceding formula may represent different alkyl groups. Compounds with two or three hydrogen radicals are described by KNOTH U.S. Pat. No. 3,149,163. Typical cations are methylammonium $(CH_3)NH_3+$, dimethylammonium $(CH_3)_2NH_2+$, trimethylammonium $(CH_3)_3NH+$, and triethylammonium $(CH_3CH_2)_3NH+$.

d. substituted hydrazinium cations, wherein the salt has the general formula $(R_2NNR_2H)_2B_{10}H_{10}$, where R can be hydrogen (H) or an alkyl radican (preferred radicals contain less than six carbon atoms), and the substituted alkyl groups can be symmetric or assymmetric with respect to the N=N linkage. Symmetric substituted cations are described by KNOTH U.S. Pat. No. 3,149,163. An example of an unsymmetric substituted cation is (1,1) dimethylhydrazinium. The R's in the preceding formula may be mixed alkyl radicals.

e. quaternary ammonium salts of the general formula $(R_4N)_2B_{10}H_{10}$, where R is an alkyl radical; the R's in the preceding formula may represent mixed alkyl groups. Examples of typical cations are tetramethylammonium $(CH_3)_4N^+$ and tetraethylammonium $(CH_3CH_2)_4N^+$.

f. aryl containing cations, such as pyridinium, bypyridinium, or substituted aryl cations, such as aryldiazonium cations.

g. guanidinium ion, $C(NH_2)_3^+$, wherein the salt has the formula $(C(NH_2)_3)_2B_{10}H_{10}$, and is described in an application of common assignment, entitled BISGUANIDINIUM DECAHYDRODECABORATE AND A PROCESS FOR ITS PREPARATION, filed June 10, 1976 and now U.S. Pat. No. 4,002,681.

h. metal ions, derived from metals defined by a Periodic Table such as that in the "Handbook of Chemistry and Physics", 54th Edition, inside front cover, by the elements in Groups 1, 2, 8, 3*b*, 4*b*, 5*b*, 6*b* and 7*b*, and the elements of Groups 3*a*, 4*a*, 5*a* and 6*a* with atomic numbers greater than 5, 14, 33, and 52, respectively. The metal decahydrodecaborate salts are further described by KNOTH U.S. Pat. No. 3,148,939. Examples of such metal salts are $Cs_2B_{10}H_{10}$ and $K_2B_{10}H_{10}$, the cesium and potassium salts of decahydrodecaboric acid, which are representative of alkali metal salts preferred for the compositions described in this invention.

Class (2)

An intimate blend of the compounds described in Class (1) above, with an oxidizing agent, in a manner that a chemically and physically different product is obtained than the starting materials.

The process by which the compositions of this class are prepared produces a very intimate blend of decahydrodecaborate (−2) ion with the oxidizer and makes the compositions so prepared chemically and physically unique from physical blends of decahydrodecaborate (−2) salts with oxidizer or pyrotechnic compositions incorporating decahydrodecaborate (−2) salt, as described above, and also dissolving, in the same solution, an oxidizing agent, as described above. The subject composition is recovered by precipitating the composite ingredients of the solution with a suitable nonsolvent. The resulting solid, after filtration and drying, comprises and intimate mixture of the decahydrodecaborate (−2) anion with the oxidizing cation or substance, in a form that is chemically and physically different than the starting materials.

The process may be properly called a "cocrystallization" or "coprecipitation" and the resulting produce a "cocrystallate" or "coprecipitate."

These unique coprecipitated Class (2) salts, containing the $B_{10}H_{10}^{-2}$ anion, and the process for their creation, are themselves further disclosed and the above-referenced copending patent application of common assignment entitled COPRECIPITATED PYROTECHNIC COMPOSITION PROCESSES AND RESULTANT PRODUCTS.

The ignition compounds may be soluble or insoluble in the solvent or liquid carrier. The solvent or liquid carriers used in coating grains are of such a type that the propellant ingredients will not react with the contracting liquid. The purpose of the solvent or carrier is to provide a softening and/or solvating of the propellant surfaces in order that the decahydrodecaborate compound will adhere to the grain surface or be chemically or physically incorporated into the propellant matrix. For this purpose, a wide variety of chemically pure solvents and vehicles or mixtures of these solvents and vehicles may be used by those practiced in the art to control the solvating ability. Preferred solvents and vehicles which are compatible with common propellant ingredients include those with functional organic groups such as ketones (acetone, methyl ethyl ketone, methyl isobutyl ketone); alcohols (methanol, ethanol, isopropanol, butyl alcohols, diacetone alcohol), esters (butyl acetate, ethyl acetate, dibutylphthlate), ethers (ethyl ether, isopropyl ether). Other solvents and vehicles which would meet specific solubility, nonreactivity, and volatility requirements are available, and the above list is not meant to be limiting. Mixtures of the forementioned solvents are commonly used to control one or more critical parameters. Some mixtures may contain a small amount of adhesive such as collodion (4 grams pyroxylin (chiefly nitrocellulose) in 100 ml of a mixture of 1 volume ethanol and 3 volumes ethyl ether).

The ignition compositions, depending on the class, which are the key elements in this invention, may be soluble or insoluble in the solvent or carrier used in the coating process, and the choice of solvent or carrier system depends somewhat on the type of ignition compound to be used.

The simple decahydrodecaborate salts, represented by Class (1) of the preceding list of the specific ignition aides, may be soluble or insoluble in the solvent or vehicle system used. A critical requirement of the use of these simple salts is an intimate contact with the propellant ingredients of each grain (particularly nitrocellulose with or without nitroglycerine), which ingredients must act as oxidizers to combust the salt, which acts as a fuel. The result of the intimate interface of binder oxidizer and fuel is a layer which will have a faster burning rate than the original propellant composition, and one which lies on the exterior surface of each of the original propellant grains.

To achieve the required intimate contact between propellant oxidizer and decahydrodecaborate salt, it is necessary that the salt either be dissolved in the solvent or vehicle, or be of a very fine particle size that is suspended in the fluid. Ten microns average diameter is a preferred upper limit on the average diameter of undissolved salt crystals.

Representative examples of Class (1) decahydrodecaborate salts dissolved in a solvent and carrier system are bisammonium decahydrodecaborate in acetone/ethanol or isopropanol, and dipotassium decahydrodecaborate in acetone/ethanol. The solubility of the decahydrodecaborate salts in solvent systems varies considerably, and must be considered separately for each individual case. In general, the decahydrodecaborate salts with relatively small cations, as represented by Class 1(a) and 1(b) and certain members of Classses 1(c) (such as methylammonium or dimethylammonium), 1(d) and 1(h) such as sodium or potassium, are more likely to be soluble in selected members from the list of solvents than salts with larger molecular weight cations, for example, cesium or tetramethylammonium. It is desirable to initially dry; i.e., remove water, from the prepared solutions by, for example, letting the prepared solutions stand over calcium sulfate, in order to avoid introducing excess moisture into the individual coated propellant grains.

Examples of useful decahydrodecaborate salts insoluble in most solvents and carriers are tetramethylammonium decahydrodecaborate and dicesium decahydrodecaborate, which may be incorporated into a surface layer by suspending them in a carrier which has some solvent ability on the propellant as for example, butyl acetate/ethanol, acetone/ethanol, or ether/acetone mixtures. The solvent with the suspended decahydrodecaborate salt is applied to the propellant in the same manner as the pure solvent.

The decahydrodecaborate compounds of Class (2), i.e., decahydrodecaborate salts coprecipitated with an oxidizer, must be insoluble in the coating fluid, in order that the intimate crystalline structure of the coprecipitate is not degraded. As with the insoluble simple salts, the Class (2) compounds may be suspended in the propellant solvent or vehicle. In contrast to the insoluble simple salts of Class (1), the Class (2) coprecipitates are self combusting, and do not require the oxidative ingredients of the propellants to achieve ignition enhancement. They may thus be applied in an outer layer in such a manner than the propellant solvent/suspended ignition carrier system does not penetrate as deeply into the surface of the propellant grains as that for the Class (1) compounds, for example, by using a carrier such as isopropanol, which does not have appreciable solvent ability on typical propellants, but which will soften the propellant surface sufficiently for the Class (2) ignition compounds to adhere to the surface forming an outer layer. Examples of Class (2) ignition composition and acceptable solvent carriers are the coprecipitate of 25-parts-by-weight cesium decahydrodecaborate and 75 parts-by-weight potassium nitrate with isopropanol, butyl acetate/ethanol, acetone/ethanol, or ether/ethanol carriers and the coprecipitate of 15-parts-by-weight tetramethylammonium decahydrodecaborate and 85-parts-by-weight potassium nitrate with the same carriers.

The coating process preferably consists of initially dissolving or suspending the decahydrodecaborate compound in a predetermined concentration in the solvent or carrier. The amount of propellant solvent fluid preferred for the coating process is between 0.010 and 0.300 milliliters of fluid (for solution or suspension of the salt compound), per gram of propellant. The preferred limits on decahydrodecaborate compounds are, as follows:

Class (1) soluble: 0.1 to 1.0% of the total propellant weight;

Class (1) insoluble: 0.3 to 2.0% of the total propellant weight; Class (2): 0.5 to 4.0% of the total propellant weight.

The required concentration of the ignition compound in the coating fluid may be calculated for each case from the amount of fluid to be used and the percent concentration of the ignition compound desired.

The propellant is wetted with the requisite amount of the solution or suspension and mixed well. In the case of a solvent with substantial solvating power, a lesser amount of solution is preferred, and the solution or suspension is rapidly absorbed by the propellant. In the case of a fluid with low solvating power, the propellant may be tumbled in the fluid for a longer time, allowing a suspended decahydrodecaborate solid to adhere to the softened surface, or a dissolved salt to penetrate into a thin surface layer. The containing device may be any convenient flask, for example, a stainless steel beaker, or, in the case where a tumbling action is preferred, a rotating drum of nearly curcular cross section, known affectionately to those practiced in the art as a "sweetie barrel."

Consequently, the ignition compositions remain in a surface layer of variable thickness (depending on the solvent power of the coating fluid) on the surfaces of the individual grain. This new layer provides a fast buring channel which aids in uniform flame front propagation over each of the grain surfaces. The decahydrodecaborate salt may be considered a burning rate catalyst or ignition enhancer seeded into the propellant surface, or alternately, the coating layer may be considered to have created a new propellant composition with a burn rate higher than the propellant initially present in the grain, the two interpretations being one and the same, and physically equivalent.

As with most commonly used propellants, it is often desirable to apply a layer or coating of graphite to the exterior surface, to aid in safe handling of the propellant. Within this invention, the use of an optional graphite coating is preferably applied as a last, outer coating, to protect the decahydrodecaborate coating or layers. This graphite coating is conveniently applied by adding to the decahydrodecaborate coated or impregnated propellant—while it is still wetted or softened with the coating solvent—a loose graphite layer, and then tumbling, vibrating, or rolling the coated grains until a shiny or glazed appearance is obtained, as commonly practiced by those experienced in the art.

The coated propellants prepared by this method, after a suitable drying period, exhibit substantially better ignition properties than untreated units. The effect of the introduction of the ignition composition directly into the propellant surface is to place the ignition stimulus in very intimate contact with, in fact, as part of, the propellant surface, so as to achieve a direct heat input to the surface.

The ignition enhancement is illustrated by the following example.

EXAMPLE I

A typical uncoated single base propellant, consisting of approximately 93.3% nitrocellulose (of nitrogen content 13.15%), 4.8% ethylcentralite as stabilizer and deterrent, 0.8% diphenylamine, 0.8% lead carbonate, 0.3% potassium sulfate, and 1.3% residual moisture and volatiles, such as can be purchased as Canadian Industries Limited SPDN 1462, is chosen as representative of the class of uncoated single, double and triple base propellants considered as starting materials in this invention. Any propellant so chosen is necessarily procured without an initial graphite glaze present on the surface of each grain.

A series of ignition enhancing coatings or layers of decahydrodecaborate compounds are applied according to Table I. Two control propellants, incorporating as a glaze layer 0 and 1.9% graphite, and denoted as A and B respectively, are prepared and subjected to the same conditioning and history as the decahydrodecaborate coated propellants.

A solvent and carrier consisting of 65%-by-volume ethanol and 35%-by-volume acetone is chosen as representative of the manifold of solvents available.

Propellant B is prepared by wetting the uncoated propellant with 0.17 milliliters solvent per gram propellant, and tumbling the wetted propellant in a cup containing approximately 0.25 grams of graphite (of such a particle size so as to pass through a 325 mesh screen) per gram propellant. The coated propellant grains with the adhering graphite powder is vibrated on a screen to remove excess (loose) graphite until, via the grain-to-grain rubbing action, a smooth glazed appearance is obtained. The propellant is dried to constant weight in vacuo at 35° C, 48 hours being a sufficient drying time.

Propellants C and D are coated with decahydrodecaborate compounds soluble in the chosen solvent and carrier, as delineated on Table I. Solutions consisting of 0.125 grams of the decahydrodecaborate compounds per milliliter of solution are prepared and dried over calcium sulfate. The uncoated propellant is placed in a cup and wetted with 0.10 to 0.13 milliliters solution per gram propellant and stirred until the grains are uniformly coated. Then 0.25 grams graphite per gram propellant is added to the cup and stirring continued until the grains have a dry appearance. A small amount of residual graphite and powder remains in the cup. The coated propellant is placed on a dried screen and vibrated and then dried in a manner identical with Propellant B. The actual coating percentages-by-weight, as given on Table I, are derived by simultaneously treating and drying identical batches of (a) uncoated propellant and (b) propellant coated only with decahydrodecaborate compound, weighing all three samples, and computing the appropriate coating weights.

TABLE I

| Propellant Designation | Decahydrodecaborate Type | Compound % | Graphite % |
|---|---|---|---|
| A (Control) | — | 0 | 0 |
| B (Graphite glaze control) | — | 0 | 1.9 |
| C | Ammonium decahydrodecaborate (Class Ia)[1] | 1.0 | 1.0 |
| D | Potassium decahydrodecaborate (Class Ih)[1] | 1.0 | 1.1 |
| E | 15% tetramethylammonium decahydrodecaborate coprecipitated with 85% potassium nitrate (Class II)[2] | 0.9 | 1.1 |
| F | " | 2.7 | 1.1 |

[1] soluble in the solvent used
[2] insoluble in the solvent used

Propellants E and F are prepared by suspending 0.086 grams per milliliter, and 0.20 grams per milliliter, respectively, of the Class (2) decahydrodecaborate compound in the solvent carrier, and applying 0.15 milliliters of the resulting suspension per gram of propellant to the dry propellant. Graphite coating and computation of the coating weights are accomplished in a manner identical with that used for Propellants C and D.

The control and coated propellants are tested by loading 0.20 grams of the applicable propellant into a 0.38 special caliber cartridge case primed with a No. 500 small pistol primer; a stainless steel wire screen (60 mesh) is pressed over the load. The cartridge is mounted in a chamber and breech assembly with a firing pin, and fired into a 10 cc closed bomb. Pressure is measured as a function of time with a high speed transducer and recorded on an oscillograph. Tests at low temperature were performed by conditioning the entire test assembly to −65° F and firing the unit.

The primary criteria, as shown in Table II, for comparison between control units and decahydrodecaborate compounds is the ignition time, defined as the first measurable deviation from the starting pressure baseline to 10% of the peak pressure. Other criteria, also shown on Table II, are the peak pressures obtained, the time between deviation from baseline and peak pressure, and the slope of the curve between the 10% and 90% $(dP/dt)_{0.10-0.90}$ of peak pressure points.

TABLE II

| Propellant | Temp. ° F | Ignition Time (msec) | Peak Pressure (psi) | Time to Peak Pressure (msec) | (dP/) (dt).10-.90 (psi/msec) |
|---|---|---|---|---|---|
| A | 70 | 10–16 | 1150–1340 | 38–56 | 29–49 |
| | −65 | 6–37 | 975–1435 | 39–75 | 32–38 |
| B | 70 | 20–28 | 1355–1475 | 50–58 | 44–52 |
| | −65 | 12–35[1] | 1215–1405[1] | 47–75[1] | 31–39[1] |
| C | 70 | 10.5–14 | 1320–1495 | 42–46 | 43-55 |
| | −65 | 10.3–14 | 960–1300 | 46–54 | 28–41 |
| D | 70 | 4.4–6.4 | 1310–1370 | 30–33 | 49–57 |
| | −65 | 9.5–14 | 1130–1310 | 40–48 | 33–45 |
| E | 70 | 6.2–7.9 | 1345–1370 | 33–38 | 57–56 |
| | −65 | 11.9–15.0 | 1230–1245 | 46–50 | 37–39 |
| F | 70 | 3.5–8.1 | 1280–1380 | 30–38 | 43–54 |
| | −65 | 5.4–12.3 | 960–1170 | 38–48 | 26–40 |

[1] ¼ fall to ignite; primer functioned properly.

The derived data of Table II illustrate the range of ignition properties that can be obtained by varying the type and amount of decahydrodecaborate compound. In all cases, the ignition time and variation in ignition times is lower than the graphite coated control. Propellant C shows a significant property in that the ignition time is virtually independent of ambient (conditioning) temperature, which is a very important property for devices incorporating propellant, such as automatic cannon, which depend on a reproducible ignition. Propellants D, E and F, in addition to short and reproducible ignition times, incorporate an inherent flask reducer in the form of the potassium content of the decahydrodecaborate compounds.

In summary, the present invention involves the coating of individual grains of nitrocellulose-based propellants, in order to provide an ignition layer completely surrounding each volume of propellant. The types of decahydrodecaborate compounds employed commonly have the $B_{10}H_{10}(-2)$ anion, which is an anion believed to be kinetically, rather than thermodynamically stabilized upon thermal decomposition. The present invention involves applying individual layers upon each of the propellant grains, so that these individual layers will act as ignition aids to the propellant material which they surround. Granular propellants are commonly used in gun applications, and the present invention allows for preformulated propellants to be treated after manufacture, by the novel teachings of the present invention. Such granular propellants present unusual handling problems, and are normally coated with a graphite layer, for the purposes herein before described. According to the present invention any such graphite layer must necessarily be applied after the ignition layer has been applied, and if such an optional graphite layer is used the resultant propellant granules or grains may be handled as easily as conventional gun propellants which have also been treated with graphite layers. Accordingly, the present invention allows the incorporation of a ignition aid layer directly upon the exterior surfaces of each grain, and if a subsequent graphite layer is employed the handling problems are no greater than they would be with conventional propellant grains having such a graphite layer.

The products derived from the process of the present invention may of themselves be considered unique new forms of granular propellants, since they contain distinguishable cores of propellant materials surrounded by an identifiable covering layer of the ignition aid. It should be emphasized that all of the propellant aids taught herein take advantage of the unique decomposition properties of the $B_{10}H_{10}(-2)$ anion, and regardless of the choices for a cation in the salt the ignition times become virtually independent of the ambient conditioning temperatures to which the granular propellants are exposed prior to ignition. The present invention, therefore, teaches a new process for producing granular nitrocellulose-based propellant grains, and a resultant product, which will significantly allow reproducible ignition times, a requirement particularly important in such gun applications as the automatic cannon.

Having described and illustrated representative embodiments of both classes of the decahydrodecaborate compounds contemplated according to the teachings of the present invention, it is to be understood that the invention is to be defined solely by the scope of the appended claims.

We claim:

1. A process for incorporating an ignition compound comprised of certain dechydrodecaborate compounds directly upon exterior surfaces of uncoated nitrocellulose-based propellant grains, through the steps of:

(A) wetting uncoated, loose propellant grains on their exterior surfaces with a coating fluid having a solvating effect on said grains, the coating fluid being in the range of approximately 0.010 to 0.100 milliliters of fluid per gram of propellant, (B) introducing a layer of decahydrodecaborate compound onto the exterior surfaces of said grains as the result of the wetting effect of said coating fluid, wherein said compound is in the range of approximately 0.1 to 4.0% of the total propellant weight, wherein said compound further includes a salt selected from the class of salts having the common anion $B_{10}H_{10}^{-2}$, and a cation selected from the group consisting of:

(i) ammonium, wherein the salt has the formula $(NH_4)_2B_{10}H_{10}$;

(ii) hydrazinium, wherein the salt has the general formula $(NH_2NH_3)B_{10}H_{10}$;

(iii) metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52; and, (C) drying the thusly coated propellant grains until the exterior surface of each grain presents a dry appearance.

2. The process according to claim 1 wherein the decahydrodecaborate compound selected is soluble in the coating fluid, and the step of introducing said compound further consists of first dissolving said compound in said fluid, and wetting the exteriors of said propellant grains with the solution in order to form said layer on each grain.

3. The process according to claim 1 wherein the decahydrodecaborate compound selected is insoluble in the coating fluid, and the step of introducing said compound further consists of first suspending compound particles of approximately ten microns average diameter in said fluid, and wetting the exterior of said propellant grains with the suspension in order to form said layer on each grain.

4. The process according to claim 1 wherein said compound is insoluble in said fluid and is the resultant product of a coprecipitation of one of said salts with a solid oxidizing agent by the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

5. A process according to claim 1 wherein the step of drying the coated grains further comprises tumbling the wetted and coated propellant grains in a container containing fine particle graphite powder, thereafter vibrating the coated grains with the adhering graphite powder to create a glazed appearance, as the result of grain-to-grain rubbing action, and drying the glazed grains to a dry appearance.

6. The process according to claim 1 wherein said uncoated granular nitrocellulose based propellant is selected from the group consisting of nitrocellulose, nitrocellulose/nitroglycerine and nitrocellulose/nitroglyercine/nitroguanidine based gun propellants.

7. The process according to claim 1 wherein the coating fluid having a solvating effect on said uncoated propellant grains includes one or more members from the group consisting of:

acetone,
methyl ethyl ketone,
methyl isobutyl ketone,
methanol,
ethanol,
isopropanol,
butyl alcohols,
diacetone alcohol,
butyl acetate,
dibutylphthlate,
ethyl ether and
isopropyl ether.

8. The process according to claim 1 wherein said decahydrodecaborate compound selected is bisammonium decahydrodecaborate, said coating fluid is a mixture of approximately 65% by volume ethanol and 35% by volume acetone, and said introducing step further consists of first dissolving approximately 0.125 gram of said salt per milliliter of said fluid prior to said wetting step.

9. The product of a coated granular propellant according to the process of claim 8.

10. A process according to claim 1 wherein the decahydrodecaborate compound selected is a simple metallic salt selected from the group consisting of cesium decahydrodecaborate, $Cs_2B_{10}H_{10}$, potassium decahydrodecaborate $K_2B_{10}H_{10}$, and the simple metallic decahydrodecaborates salts of the alkaline and alkaline earth metals of Groups 1a and 2a having an atomic number less than 87.

11. The process according to claim 10 wherein said decahydrodecaborate compound selected is bispotassium decahydrodecaborate, said coating fluid is a mixture of approximately 65% by volume ethanol and 35% by volume acetone, and said introducing step further consists of first dissolving approximately 0.125 gram of said salt per milliliter of said fluid prior to said wetting step.

12. The product of a coated granular propellant according to the process of claim 11.

13. A process for incorporating an ignition compound comprised of certain dechydrodecaborate compounds directly upon exterior surfaces of uncoated nitrocellulose-based propellant grains, through the steps of:

(A) wetting uncoated, loose propellant grains on their exterior surfaces with a coating fluid having a solvating effect on said grains, the coating fluid being in the range of approximately 0.010 to 0.100 milliliters of fluid per gram of propellant, and (B) introducing a layer of decahydrodecaborate compound onto the exterior surfaces of said grains as the result of the wetting effect of said coating fluid, wherein said compound is in the range of approximately 0.1 to 4.0% of the total propellant weight, wherein said compound further includes a salt selected from the class of salts having the common anion $B_{10}H_{10}^{-2}$, and a cation selected from the group consisting of:

(i) substituted ammonium cations, wherein the salt has the general formula $(R_3NH)_2B_{10}H_{10}$, wherein further R is selected from the group consisting of hydrogen and alkyl radicals containing less than six carbon atoms;

(ii) substituted hydrazinium cations, wherein the salt has the general formula $(R_2NHR_2H)_2B_{10}H_{10}$ wherein further R is selected from the group consisting of hydrogen and alkyl radicals contain less than six atoms;

(iii) tetramethylammonium, $(CH_3)_4N+$, tetraethylammonium, $(CH_3CH_2)_4N+$, and quanternary ammonium cations having the general formula $R_4N+$ where R is an alkyl radical;

(iv) pyrididinium, bipyridinium aryl-diazonium, aryl containing cations and substituted aryl containing cations.

(v) the guanidinium cation, $C(NH_2)_3+$; and (D) drying the thusly coated propellant grains until the exterior surface of each grain presents a dry appearance.

14. The process according to claim 13 wherein the decahydrodecaborate compound selected is soluble in the coating fluid, and the step of introducing said compound further consists of first dissolving said compound in said fluid, and wetting the exteriors of said propellant grains with the solution in order to form said layer on each grain.

15. The process according to claim 13 wherein the decahydrodecaborate compound selected is insoluble in the coating fluid, and the step of introducing said compound further consists of first suspending compound particles of approximately ten microns average diameter in said fluid, and wetting the exterior of said propellant grains with the suspension in order to form said layer on each grain.

16. The process according to claim 13 wherein said compound is insoluble in said fluid and is the resultant product of a coprecipitation of one of said salts with a solid oxidizing agent by the steps of:

(i) dissolving both the decahydrodecaborate (−2) salt and the oxidizing agent in a mutually soluble solvent, at a temperature sufficiently high to maintain said salt and said oxidizing agent in solution;

(ii) forming a pressurized stream of said solution and bringing said solution stream together with a pressurized stream of a miscible nonsolvent, under conditions of extreme turbulence within a mixing chamber, to effect a substantially complete coprecipitation;

(iii) recovering the coprecipitated product by filtering the effluent from said mixing chamber, and washing said product with an inert and nonsolvent fluid;

(iv) drying the product to remove all remaining liquid.

17. A process according to claim 13 wherein the step of drying the coating grains further comprises tumbling the wetted and coated propellant grains in a container containing fine particle graphite powder, thereafter vibrating the coated grains with the adhering graphite powder to create a glazed appearance, as the result of grain-to-grain rubbing action, and drying the glazed grains to a dry appearance.

18. The process according to claim 13 wherein said uncoated granular nitrocellulose based propellant is selected from the group consisting of nitrocellulose, nitrocellulose/nitroglycerine and nitrocellulose/nitroglyercine/nitroguanidine based gun propellants.

19. The process according to claim 13 wherein the coating fluid having a solvating effect on said uncoated propellant grains includes one or more members from the group consisting of:

acetone,
methyl ethyl ketone,
methyl isobutyl ketone,
methanol,
ethanol,
isopropanol,
butyl alcohols,
diacetone alcohol,
butyl acetate,
dibutylphthlate,
ethyl ether and
isopropyl ether.

20. The process according to claim 13 wherein said decahydrodecaborate compound selected is bisammonium decahydrodecaborate, said coating fluid is a mixture of approximately 65% by volume ethanol and 35% by volume acetone, and said introducing step further consists of first dissolving approximately 0.125 gram of said salt per milliliter of said fluid prior to said wetting step.

21. The product of a coated granular propellant according to the process of claim 20.

22. The process according to claim 16 wherein the coprecipitated decahydrodecaborate compound is approximately 15 to 25% by weight ammonium decahydrodecaborate and the remainder an oxidizing agent selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate, wherein further the coating fluid includes one or more members selected from the group consisting of isopropanol, butylacetate/ethanol, acetone/ethanol, and ether/ethanol.

23. The product of a coated granular propellant according to the process of claim 22.

* * * * *